US005174467A

United States Patent [19]

Sullivan

[11] Patent Number: 5,174,467

[45] Date of Patent: Dec. 29, 1992

[54] CONVECTOR TRAY FOR A FAN COIL UNIT

[76] Inventor: John T. Sullivan, 3910 Madison St., Hyattsville, Md. 20781

[21] Appl. No.: 734,716

[22] Filed: Jul. 23, 1991

Related U.S. Application Data

[63] Continuation-in-part of Ser. No. 681,234, Apr. 5, 1991, Pat. No. 5,071,027.

[51] Int. Cl.[5] ..... B65D 6/10

[52] U.S. Cl. ..... 220/571; 220/DIG. 6; 62/291

[58] Field of Search ..... 220/571, DIG. 6; 62/285, 290, 291

[56] References Cited

U.S. PATENT DOCUMENTS 2,531,159 11/1950 Rowell ..... 220/571
3,102,654 9/1963 Millman et al. ..... 62/291
4,712,382 12/1987 Leclear ..... 62/291
4,856,672 8/1989 Sullivan ..... 220/571
5,071,166 12/1991 Marino ..... 220/571

*Primary Examiner*—Joseph Man-Fu Moy

[57] ABSTRACT

A condensation tray includes a central main tray body formed from extruded polymeric/copolymeric material and includes a bottom wall, opposite upstanding side walls and a central wall therebetween with the bottom wall including between inner and outer surfaces thereof a plurality of condensation channels/chambers. A coil rests between the central wall and one of the side walls and an outlet from a fan projects through an opening formed between the central wall and the other of the side walls. In this fashion condensation forming adjacent the coil will not adversely effect the fan housing, impeller, motor, mounting or fasteners thereof, and condensation which collects in the condensation channels/chambers chambers can be readily passed through discharge ports of end caps to a drain.

29 Claims, 5 Drawing Sheets

FIG. 13
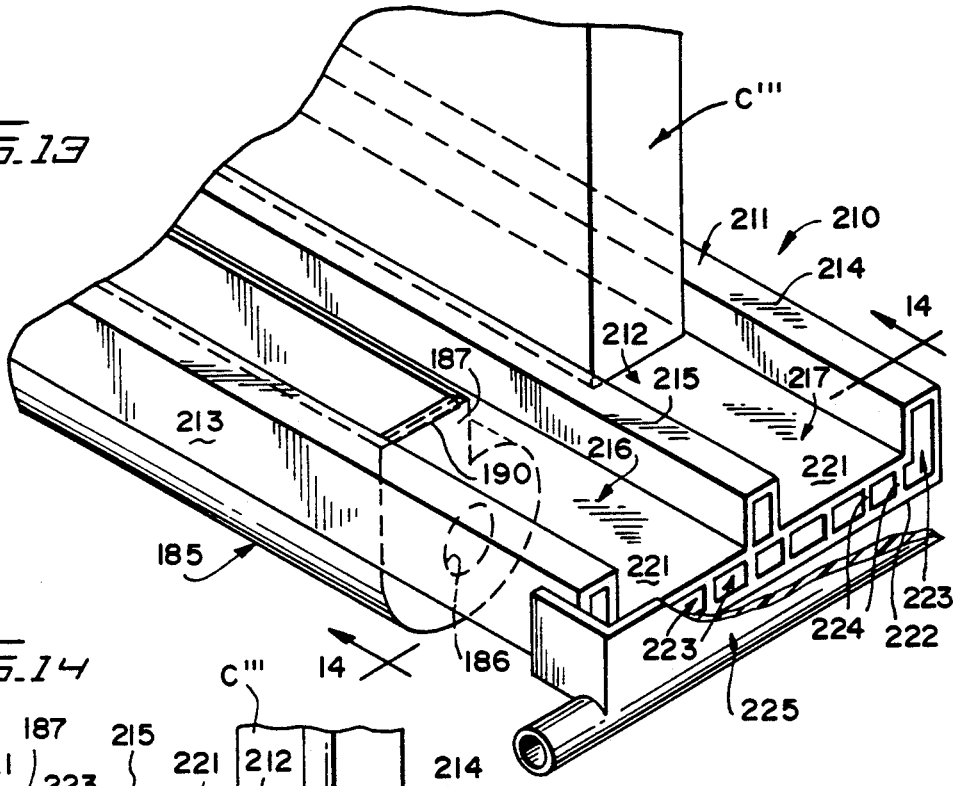
FIG. 14
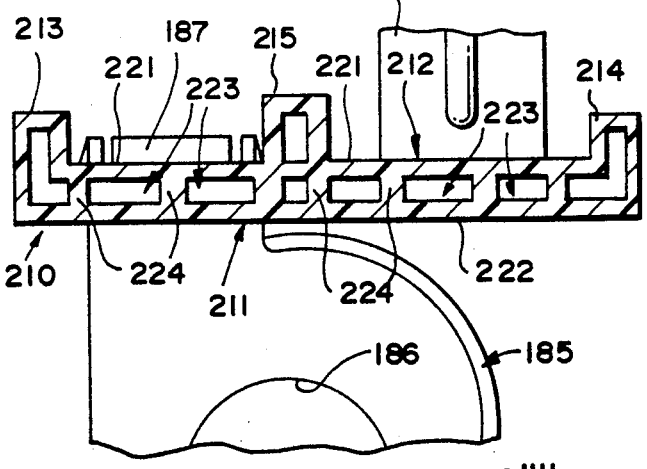
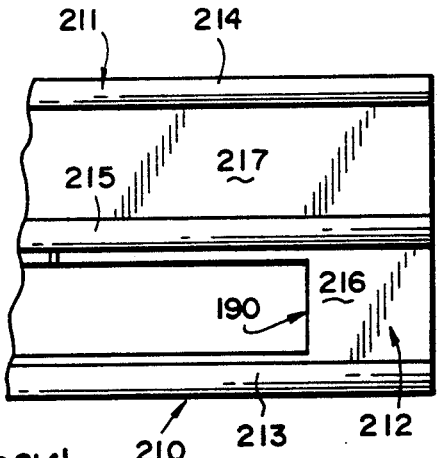
FIG. 15
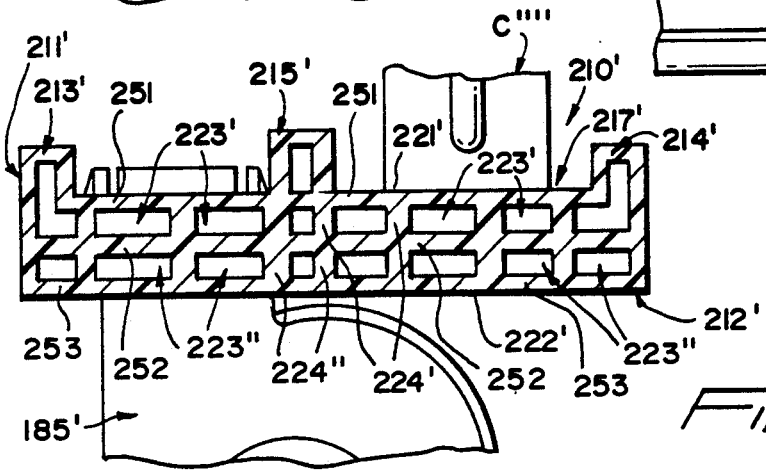
FIG. 16

CONVECTOR TRAY FOR A FAN COIL UNIT

CROSS-REFERENCE TO RELATED APPLICATION

This application is a continuation-in-part application of application Ser. No. 07/681,234 filed Apr. 5, 1991 in the name of John T. Sullivan, and now U.S. Pat. No. 5,071,027.

BACKGROUND OF THE INVENTION

Residential and commercial air conditioners include as a part thereof a fan coil unit. The fan coil unit includes a coil through which coolant (liquid or gas) is pumped, and normally the coil is spaced above or seated in a convector tray or condensation tray or pan in which condensation collects as air passes through the coil. The condensate which collects in the condensation tray is conducted by an appropriate outlet(s) and pipe(s) to a conventional drain.

Such condensation trays are generally made from galvanized metal and rust with relative ease. Disadvantages of the latter and the manner in which the same are overcome through the construction of an in situ vacuum molded polymeric/copolymeric condensation tray are set forth in U.S. Pat. No. 4,856,672 dated Aug. 15, 1989 in the name of John Sullivan. Additional novel and unobvious condensation pans/trays or convector trays are disclosed in U.S. Pat. No. 4,986,087 issued on Jan. 22, 1991 in the name of John Sullivan.

A problem unmentioned in the latter-identified patents is particularly common in condensation trays of the type in which the coil rests upon a bottom wall of the condensation tray. In such case the tray, and particularly the bottom wall of both a metallic and a plastic tray, will become cool through conduction from the coil when operating in the air conditioning mode. Surrounding ambient air collects upon the exterior surface of the condensation tray, particularly the exterior surface of the bottom wall thereof. This condensation collects, drips from the tray, and can damage interior mechanical (rust) and electrical (shorts) components of the fan coil unit. Adjoining areas can also be damaged as such condensation inevitably leaks outwardly from the fan coil unit to adjacent living areas. For example, it is not uncommon to see condensation stains adjacent fan coil units which most commonly rest on floors adjacent and beneath windows of motels. In hotels, the fan coil units are at times mounted in the ceiling of a hotel room and the dripping condensation forms highly visible stains in the ceilings. Accordingly, the damage created by condensation is not only functional damage with respect to the fan coil unit, but also aesthetic damage imparted to surrounding areas.

SUMMARY OF THE INVENTION

In keeping with the present invention, a condensation tray or convector tray is provided for fan coil units of air conditioners/heat exchangers and includes an elongated tray body in which a bottom wall has interior and exterior surfaces and between the latter surfaces are one or more channels or chambers for collecting condensation. When a coil resting upon the inner surface of the bottom wall is operating in the air conditioning mode, conduction cools the bottom wall and particularly the area most immediate the inner surface. Ambient air in the condensation channel(s) or chamber(s) condenses and can eventually be properly discharged into a drain to thereby prevent the adverse effects earlier noted.

In further accordance with the invention, the bottom wall, and preferably opposite side walls, are of an extrusion molded construction which allows for the relatively rapid and relatively inexpensive manufacture of this component of the overall condensation tray. End walls or end caps are then secured to opposite axial ends of the bottom wall in such a manner that the condensation from the condensation collection chamber(s) or channel(s) will drain into the area of the end walls or end caps and eventually be discharged therefrom.

Preferably, the end walls or end caps are injection molded and can include a drain discharge opening, outlet or port. In this manner the bottom wall and the side walls thereof can be of a simple, straightforward extruded construction and only the end walls or end caps need be specifically designed for condensation discharge, but the latter is easily accommodated by constructing these through an appropriately designed injection mold.

In further accordance with the present invention, the bottom wall includes an inner wall portion, a medial wall portion and an outer wall portion and a condensation collection chamber is formed between the inner and medial wall portions on the one hand and the medial and outer wall portions on the other. In this fashion maximum condensation collects in the condensation chamber most closely adjacent the coil, namely, the condensation collection chamber formed between the inner and medial wall portions. However, under extreme conditions of relative temperature, additional condensation can occur in the condensation collection chamber between the outer wall portion and the medial wall portion, thus effecting highly efficient collection of condensation and the subsequent discharge thereof.

In further accordance with the present invention, the condensation tray not only prevents the formation of condensation on an exterior surface thereof most adjacent an associated coil, but preferably the tray is formed as a tray body including a bottom wall, opposite generally parallel side walls, and a central wall between the side walls. An opening is formed between the central wall and one of the side walls, and the outlet of a fan housing is registered with this opening. In this fashion the central wall acts as a barrier to condensation and prevents condensation from adversely effecting the fan housing and the fan associated therewith.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 13 is a perspective view of another novel condensation pan/tray or convector pan/tray constructed in accordance with this invention which is similar to that of FIG. 1, but illustrates a tray body which includes a central wall between and generally parallel to a pair of side walls and defining with one of the side walls a tray portion having an opening in the bottom wall thereof in registry with an outlet of a fan housing.

FIG. 14 is a fragmentary cross-sectional view taken generally along line 14—14 of FIG. 13, and illustrates the relationship of the fan outlet to the latter-mentioned tray portion and another tray portion housing a bottom end portion of an associated coil with the overall tray body having a plurality of longitudinally extending condensation chambers/channels.

FIG. 15 is a fragmentary top plan view of the condensation pan or tray with the coil and fan housing removed for clarity, and illustrates an opening formed in one of the tray portions but not in the other tray portion.

FIG. 16 is a fragmentary cross-sectional view of another novel condensation pan/tray or convector pan/tray constructed in accordance with this invention similar to that of FIGS. 13 through 14, but illustrates a bottom wall formed of inner, medial and outer wall portions with the inner and medial wall portions defining one condensation collection chamber and the medial and outer wall portion defining a second condensation collection chamber.

DESCRIPTION OF THE PREFERRED EMBODIMENTS

Figure 1:
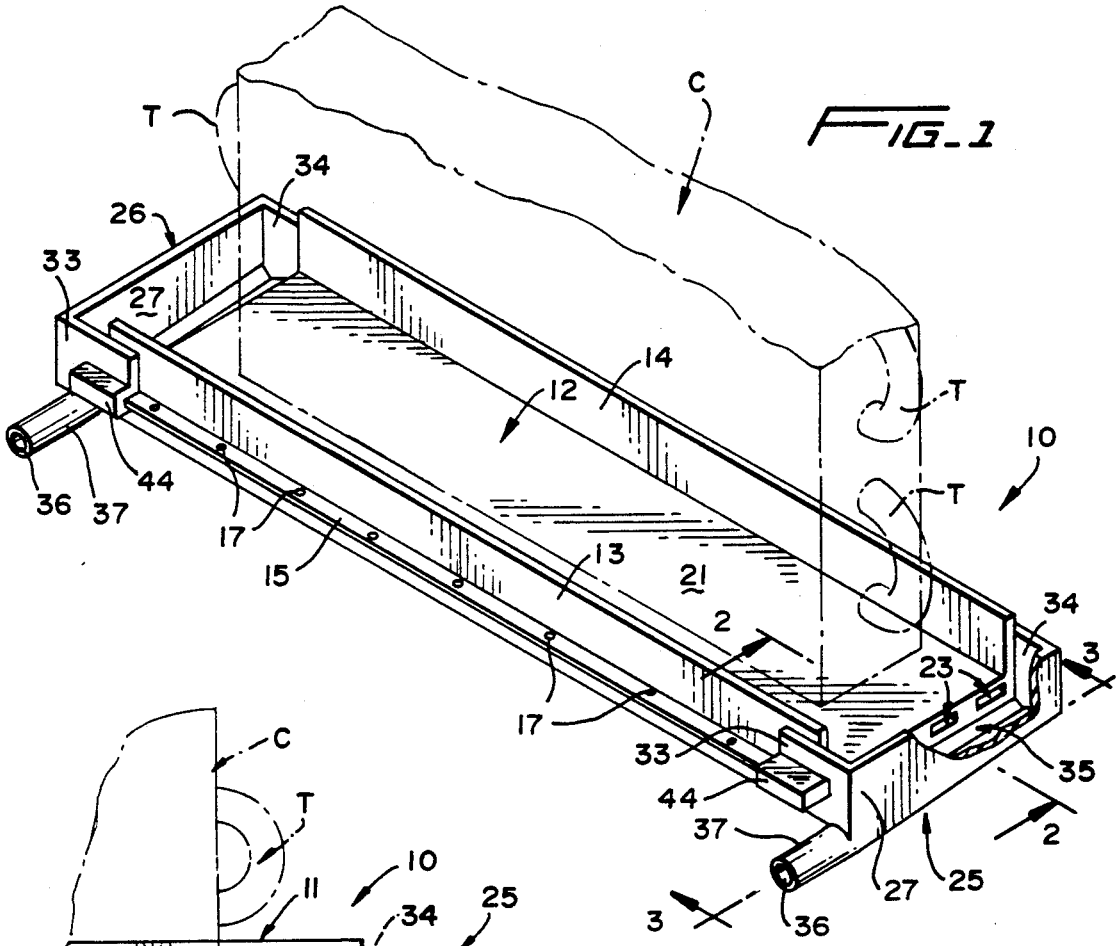
FIG. 1 is a perspective view of a novel condensation pan/tray or convector pan/tray constructed in accordance with this invention, and illustrates an injection molded central main tray body having a plurality of condensation channels/chambers, opposite tray end caps or walls closing the central main tray body, and in phantom outline a coil resting upon an inner surface of a bottom wall of the main tray body.
Figure 2:
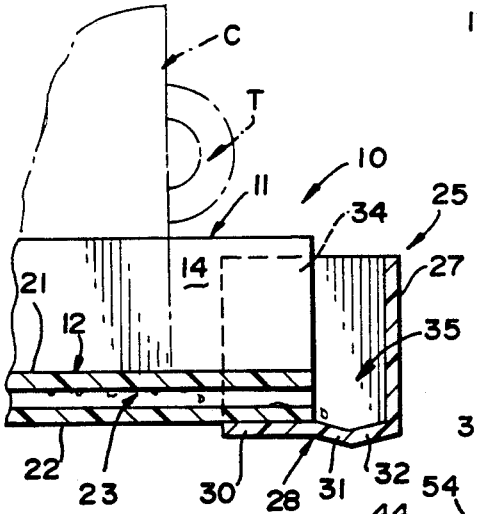
FIG. 2 is an enlarged fragmentary cross-sectional view taken generally along line 2—2 of FIG. 1, and illustrates the manner in which condensation collects in one of the condensation chambers/channels and drips into one of the tray end caps for eventual discharge to a drain.
Figure 3:
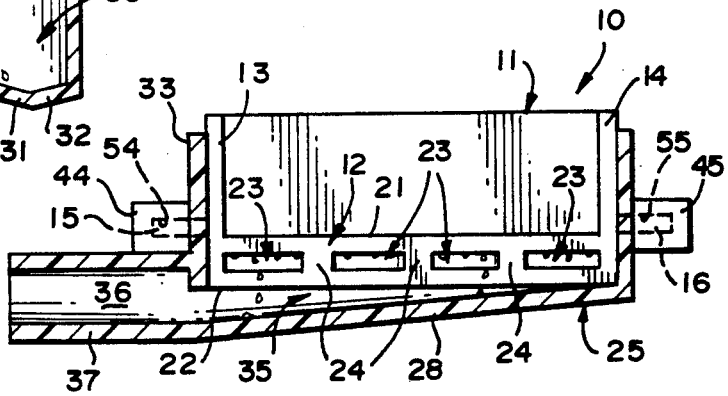
FIG. 3 is an enlarged cross-sectional taken generally along line 3—3 of FIG. 1, and illustrates the manner in which condensation collected in the tray end cap is discharged to a drain through a discharge port or outlet.

A novel condensation pan/tray or convector pan/tray constructed in accordance with this invention is illustrated in FIGS. 1 through 3 of the drawings and is generally designated by the reference numeral 10. The tray 10 is shown associated with a conventional coil F having fins (not shown) and tubing T through which a refrigerant, such as Freon, flows when operating in either the air conditioning or heating mode, and it is during the operation of the air conditioning mode that the present invention is particularly directed, as it will appear more fully hereinafter.

The condensation tray 10 includes a central main tray body 11 defined by a bottom wall 12 and opposite generally parallel side walls 13, 14. A mounting and aligning flange 15 runs the length of the side wall 13 and projects outwardly and normal therefrom, and a like mounting and aligning flange 16 (FIG. 3) similarly projects normal and outwardly from the side wall 14 and runs the length thereof. Both of the mounting and aligning flanges 15, 16 have a series of holes or openings 17 therethrough.

The bottom wall 12 includes an inner surface 21 (FIGS. 2 and 3), an outer surface 22, and a plurality of condensation channels or chambers 23 running the length of the bottom wall 12, and opening outwardly thereof at each of longitudinally opposite end faces (unnumbered). The condensation channels or chambers 23 are separated from each other by bridging walls or ribs 24. The surfaces 21, 22 are illustrated as being generally parallel to each other, but the relative relationship therebetween can be varied, as will be noted more fully hereinafter, and the same is true of the generally rectangularly shaped condensation channels or chambers 23.

The entire central main tray body 11 is formed by conventional extrusion molding from polymeric/copolymeric plastic material. Such materials as high-impact polystyrene, flexible polyethylene or impact-resistant ABS are suitable materials from which the central main tray body 11 can be injection molded. Equally capable of being injection molded is a glass-reinforced vinyl composition manufactured and sold by B. F. Goodrich Company under the trademark "Fiberlock" which incorporates both the strength and rigidity of metal parts, yet is lightweight and has high chemical resistance. B. F. Goodrich Company also produces its trademarked "Geon" vinyl which is also suitable for extrusion molding. Whatever the material, the extrusion nozzle simply has the overall transverse cross-sectional configuration (FIG. 3) of the bottom wall 12 and the side walls 13, 14 and four generally rectangular cores (not shown) associated with the extrusion nozzle form the condensation channels/chambers 23 as an indeterminate length of thermoplastic is extruded. This indeterminate length is then simply transversely cut into whatever different length or lengths are required for a particular main tray body 11 of the condensation tray 10.

Means generally designated by the reference numerals 25, 26 in the form of tray end caps or tray end walls are provided for closing the normally open ends of the main tray body 11. Since the tray end caps 25, 26 are essentially identical, the description of the tray end cap 25 set forth immediately hereinafter is applicable to the tray end cap 26.

The tray end cap 25 includes an end wall 27 (FIGS. 1 and 2) side walls 33, 34 and a bottom wall 28 having a relatively flat bottom wall portion 30 (FIG. 2) and downwardly converging bottom wall portions 31, 32 (FIG. 2) which also taper downwardly from the side wall 34 toward the side wall 33 (FIG. 3) to define an upwardly opening trough 35 which opens into a passage 36 of a tubular condensation outlet or spout 37.

The side walls 33, 34 have respective generally hollow projections 44, 45 which open axially away from the end wall 27 and transversely toward each other to define respective slots 54, 55.

In order to assemble the central main tray body 11 to the tray end caps 25, 26, the slots 54, 55 of the respective projections 44, 45 of each of the tray end caps 25, 26 are aligned with and slipped upon the respective aligning flanges 15, 16 and slid forward relative to each other until the same bottom and further movement is precluded by the abutment of the end face (unnumbered and unillustrated) of the mounting and aligning flanges 15, 16 with the end walls (unnumbered) of the projections 44, 45, respectively. The latter limits end cap movement relative to the main tray body 11 and positions the trough 35 (FIG. 2) such that condensation forming and collecting in the channels 23 will drain into the trough 35 and from the latter outwardly through the spout 37. Sonic welding, suitable thermosetting adhesives, or the like can be utilized to effect a homogeneous leak-proof seal between each of the end caps 25, 26 and the main tray body 11.

When the coil C is operating in the air conditioning mode, relatively cold refrigerant (Freon) flows through the tubes T and in turn cools the bottom wall 12 through conduction because, as earlier noted, the bottom of the coil C rests directly upon the inner surface 21 of the bottom wall 12 (See FIG. 2). Warmer ambient air surrounds the condensation tray 10 including ambient air within the condensation channels/chambers 23 which is formed into condensation droplets eventually collecting within the channels 23 in sufficient amounts to form condensation which then flows outwardly of the channels 23 into the troughs 35 for subsequent discharge to a conventional drain through the condensation outlets or spouts 37. It should be particularly noted that since the condensation forms within the channels 23, it does not form along the outer surface 22 of the bottom wall 12 and, hence, damage earlier noted from such conventional formation of condensation and its dripping into/upon the fan coil unit, its components, and adjacent rug, ceiling, etc., is precluded by the present invention.

The condensation tray 10 has been illustrated with each tray and cap 25, 26 being provided with a condensation outlet spout 37. In this case it is assumed that the condensation tray 10 is disposed generally horizontally in the associated fan coil unit by fasteners passing through the mounting and aligning flange openings 17 which are in turn suitably secured to the framework of the fan coil unit. However, if the condensation tray 10 is inclined in one direction or other, only the lower one of the tray end caps 25, 26 need be provided with a condensation outlet spout 37.

Figure 4:
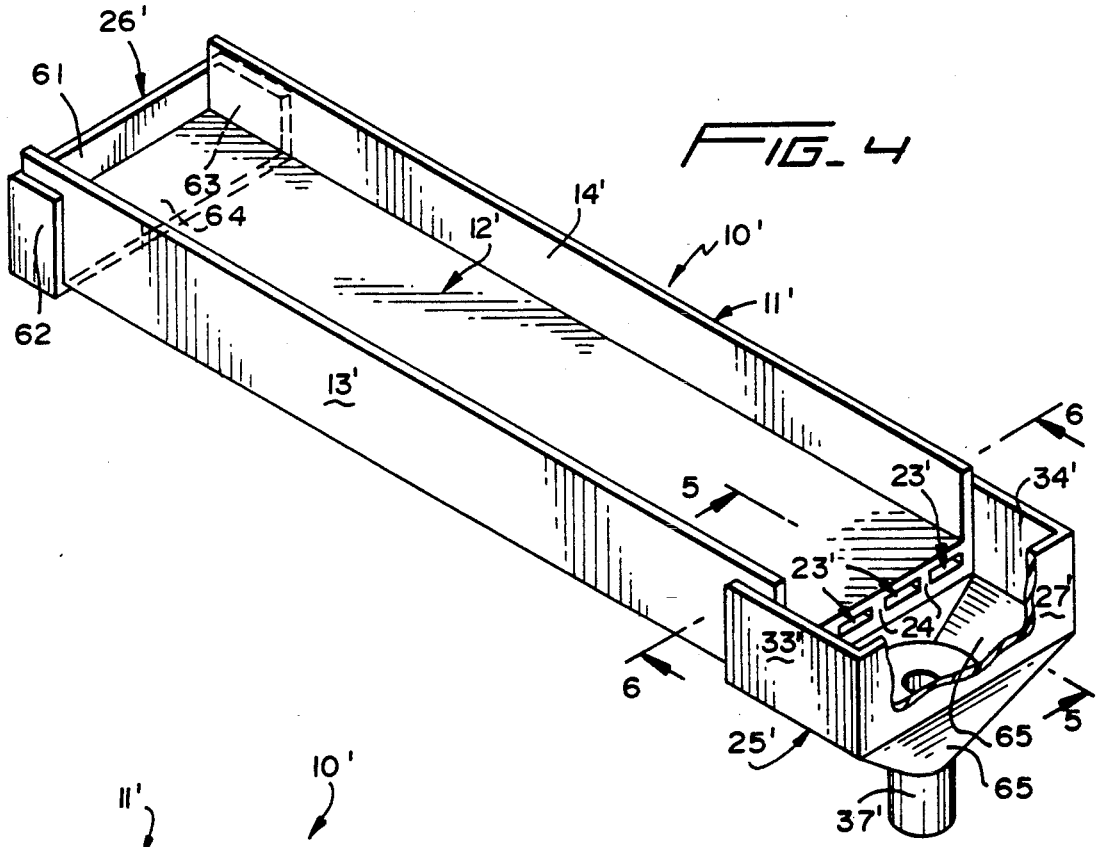
FIG. 4 is a perspective view with a portion thereof broken away for clarity of another condensation tray of the invention, and illustrates a central main tray body, opposite tray end caps or walls, and one of the tray end caps having a condensation discharge port formed therein.
Figure 5:
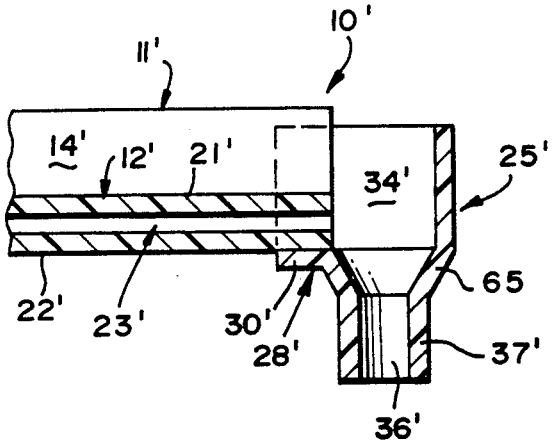
FIG. 5 is an enlarged fragmentary cross-sectional view taken generally along line 5—5 of FIG. 4, and illustrates details of the main tray body, and the associated tray end cap and its discharge port.
Figure 6:
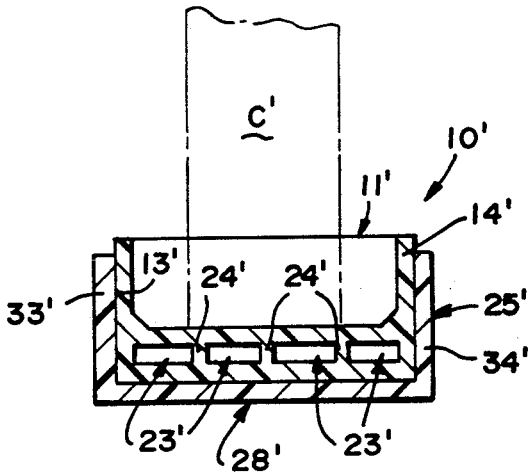
FIG. 6 is an enlarged cross-sectional view taken generally along 6—6 of FIG. 4, and illustrates details of the main tray body and the associated tray end cap.

Reference is now made to FIG. 4 which illustrates another condensation tray/pan or convector tray/pan which is similar to the condensation tray 10 of FIGS. 1 through 3 and is, therefore, identified by the reference numeral 10'. In this case a central main tray body 11 of the condensation tray 10 is identical to the central main tray body 11 of the condensation tray 10, except the flanges 15, 16 have been eliminated. Furthermore, a tray end cap or wall 26' does not include an outlet spout 37 but instead includes an end wall 61, opposite side walls 62, 63 parallel to each other and a bottom wall 64 parallel to the end wall 61 and the side walls 62, 63. The side walls 62, 63 snugly conform to exterior surfaces (unnumbered) of the main tray body side walls 13', 14' and a like relationship exists between an exterior bottom surface (unnumbered) of the bottom wall 12 and the bottom wall 64. The tray end cap 26' is, of course, hermetically sonically and/or adhesively secured to the central main tray body 11'.

An opposite tray end cap or wall 25' includes an end wall 27', side walls 33', 34', a bottom wall 28 having a flat bottom wall portion 30' and a generally centrally located vertical discharge passage 36' of a condensation outlet or spout 37' having a generally centrally located frusto-conical upwardly diverging funnel-like portion 65 which merges with the walls 27', 33' and 34'. The wall portion 30' and the walls 33', 34' are sonically or adhesively hermetically secured to the central main tray body 11'.

The condensation tray 10' is particularly adapted for utilization with a fan coil unit which allows in-line vertical downward drainage of the condensation in one direction. Thus, the left-end of the condensation tray 10' is blind or closed by the tray end cap 26', and condensation which flows outwardly from the condensation channels or chambers 23' will discharge into the tray end cap 25'. Accordingly, when the condensation tray 10' is installed in a fan coil unit, it must be appropriately inclined to allow left-to-right condensation flow in the condensation channels 23'.

Figure 7:
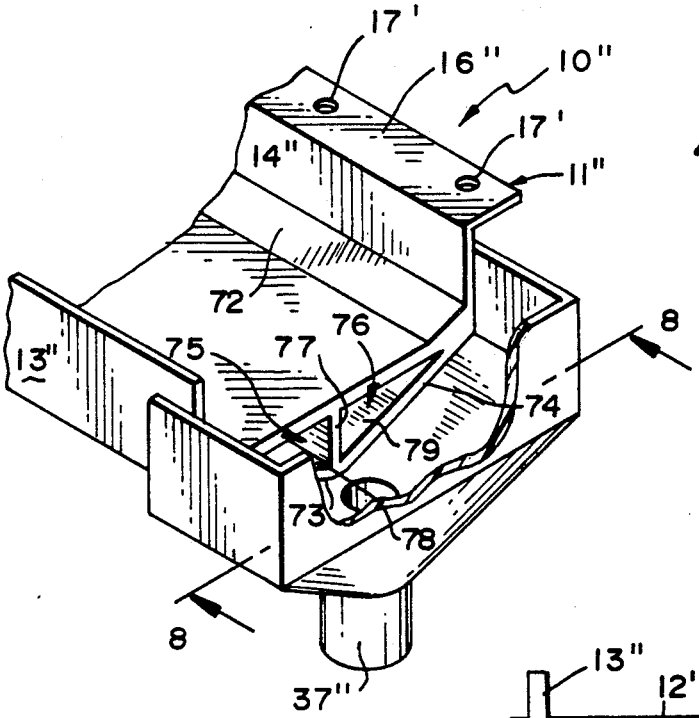
FIG. 7 is a fragmentary perspective view with a portion thereof broken away for clarity of another condensation tray constructed in accordance with this invention, and illustrates a central main tray body having a bottom wall with associated condensation chambers/channels having bottom converging surfaces to effect efficient drainage.
Figure 8:
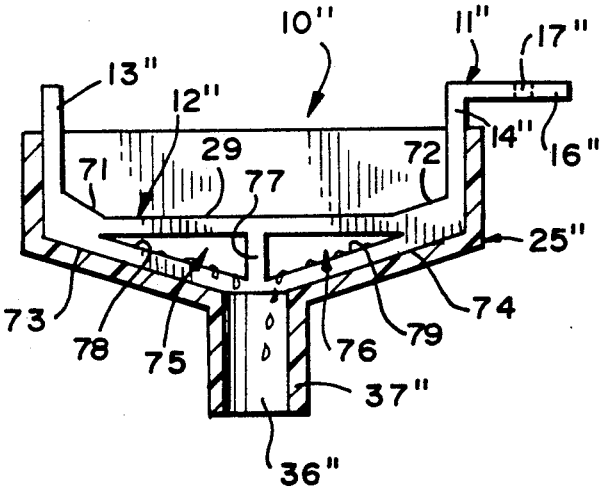
FIG. 8 is an enlarged cross-sectional view taken generally along line 8—8 of FIG. 7, and illustrates the details of the condensation chambers and the manner in which condensation flows therefrom into an associated discharge port.

Another condensation tray 10'' is illustrated in FIGS. 7 and 8 and includes a tray end cap or wall 25'' identical to the tray end cap 25' of FIG. 4. However, a central main tray body 11'' is somewhat different than the central main tray body 11' of FIG. 4. In this case, the central main tray body 11'' includes a bottom wall 12'', a side wall 13'', an opposite parallel side wall 14'', and the latter includes a mounting flange 16'' having mounting openings 17''. An inner central longitudinal bottom wall portion 21'' of the bottom wall 12'' merges at each of its longitudinal edges (unnumbered) with relatively converging surfaces 71, 72 (FIG. 8). A bottom surface of the bottom wall 12'' is defined by downwardly converging bottom surface portions 73, 74 and between the latter and the inner central longitudinal bottom wall portion 29 are a pair of condensation channels or chambers 75, 76 separated by a bridging wall or rib 77. The condensation channels 75 76 are each of a generally transverse triangular cross-sectional configuration and include respective inclined walls 78, 79 which converge toward each other and toward a condensation passage 36'' of a condensation spout 37''. As is most readily apparent from FIG. 8, the surfaces 71, 72 and particularly the surfaces 73, 74 direct condensation toward a longitudinal center line of the central main tray body for collection and eventual discharge to a drain through the condensation spout 37''.

Figure 9:
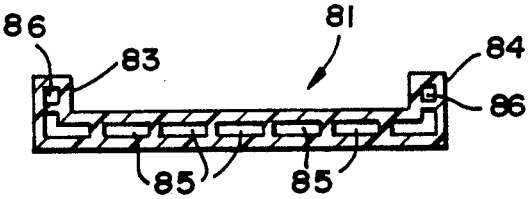
FIGS. 9 through 11 are reduced cross-sectional views taken through three different central main tray bodies illustrating a variety of cross-sectional configurations thereof, as well as associated condensation chambers/channels formed not only in a bottom wall but in upstanding side walls.
Figure 10:
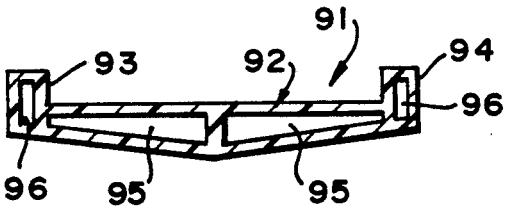
Figure 11:
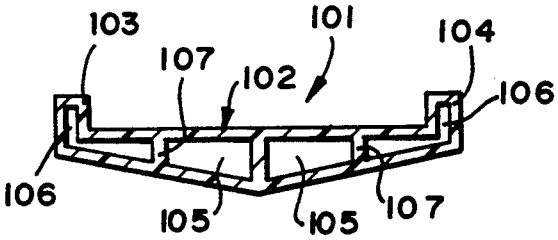

Reference is now made to FIGS. 9 through 11 of the drawings in which are illustrated central main tray bodies 81, 91, and 101, respectively. The central main tray bodies 81, 91 and 101 include bottom s walls 82, 92, 102; side walls 83–84, 93–94, 103–104; and condensation channels or chambers 85–86, 95–96 and 105–106, respectively.

The central main tray body 81 essentially corresponds to the central main tray body 11 of FIG. 1, including the formation of the condensation channels 85 in the bottom wall 82. However, the side walls 83, 84 are also provided with the condensation channels or chambers 86 and condensate formed therein will discharge in the manner heretofore described into an associated tray end cap, such as the tray end cap 25 of FIG. 1. Utilization of the condensation channels 86 in the side walls 83, 84 further assures that as much condensation as might be formed will be collected and discharged to drain without adversely effecting any associated fan coil unit or the surrounding environs.

The central main tray body 91 of FIG. 10 corresponds in cross-section generally to the central main tray body 11" of FIG. 7, but here again the side walls 93, 94 are provided with the condensation channels 96 to achieve maximum condensate collection.

The central main tray body 101 of FIG. 11 is similar to the central main tray body 91 of FIG. 10, except the condensation channels or chambers 106 of the side walls 103, 104 merge into the bottom wall 102 and are separated from the chambers 105 by bridging walls or ribs 107. This construction allows condensation in the side walls 103, 104 to flow downwardly and into the bottom wall 102 before longitudinally exiting the same.

Figure 12:
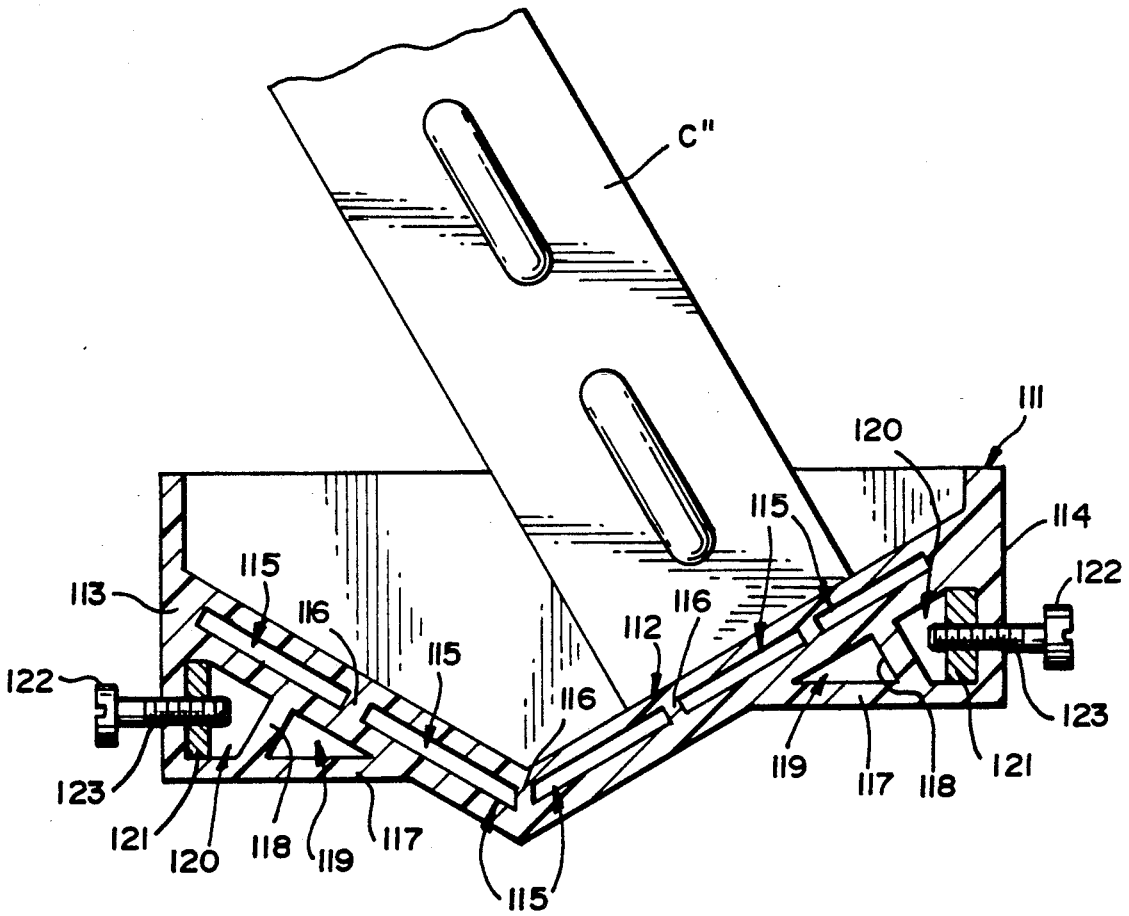
FIG. 12 is a fragmentary cross-sectional view taken through another central main tray body of a condensation tray of the invention, and illustrates the manner in which selected ones of the condensation chambers/channels accommodate square nuts for securing the central main tray body to an associated fan coil unit.

Another central tray body 111 is illustrated in FIG. 12 associated with a coil C" supported upon an inner surface (unnumbered of a bottom wall 112 which is of a generally shallow V-shaped transverse cross-sectional configuration. The bottom wall 112 merges with side walls 113, 114 and includes condensation channels or chambers 115 separated from each other by bridging walls or ribs 116 A pair of walls 117 bridge between the side walls 113, 114 and the bottom wall 112. A bridging wall or rib 118 separates each of the areas between the walls 112, 113 and 117 and 112, 114 and 117 into two channels or chambers 119, 120, each of the latter of which can receive a square nut 121. A fastener 122 is passed through an opening (not shown) of the fan coil unit or the framework thereof and through an opening 123 in each of the walls 113, 114, and is threaded into the associated square nut 121 to removably secure the condensation tray (not shown) in the associated fan coil unit. Obviously, the central main tray body 111 is extrusion molded from polymeric/copolymeric plastic material in the manner heretofore described and is hermetically sonically or adhesively bonded/secured to appropriately contoured tray end caps or walls (not shown) to effect the intent of the present invention. Such tray end caps are preferably contoured to the entire exterior profile of the central main tray body 111 so that condensate will collect and flow thereinto not only from the condensation channels 115, but also from the channels 119, 120 should any condensate form therein.

A novel condensation pan/tray or convector pan/-tray constructed in accordance with this invention is illustrated in FIGS. 13 through 15 of the drawings and is generally designated by the reference numeral 210. The tray 210 is shown associated with a conventional coil C''' having fins and tubing (not shown) through which a refrigerant, such as Freon, flows when operating in either the air conditioning or heating mode, and it is during the operation of the air conditioning mode, as earlier described, that the present invention is particularly directed in association with a fan housing 185 having generally axially opposite air inlets 186, of which only one is illustrated, and a fan housing outlet 187 of a generally polygonal or rectangular configuration. A fan motor (not shown) is supported relative to the underside of the tray 210 and includes an impeller or fan (not shown) located within the housing 185. When the fan motor (not shown) is energized, air is drawn through the air inlets 186 of the housing 185, exits the outlet 187 and flows through the fins of the coil C''' resulting in the formation of condensation during the air conditioning mode of operation, as is well known. Details of the specific construction of the housing 185 is disclosed in pending application Ser. No. 07/642,768 filed Jan. 18, 1991 entitled A VOLUIE HOUSING FOR A CENTRIFUGAL FAN BLOWER OR THE LIKE, and the subject matter thereof is incorporated hereat by reference. Details of the fan motor, its impeller, its mounting means, etc. are found in earlier mentioned U.S. Pat. No. 4,986,087, and the details of the latter are also incorporated hereat by reference.

The condensation tray 210 includes a central main tray body 211 defined by a bottom wall 212, opposite generally parallel side walls 213, 214, and a central wall 215 therebetween. The side wall 213 and the central or medial wall 215 define therebetween a tray portion 216. The side wall 215 and the central or medial wall 215 define therebetween a tray portion 217.

The bottom wall 212 includes an inner surface 221 (FIGS. 13 and 14), an outer surface 222, and a plurality of condensation channels or chambers 223 running the length of the bottom wall 212, and opening outwardly thereof at each of longitudinally opposite end faces (unnumbered). The condensation collection channels or chambers 223 are separated from each other by bridging walls or ribs 224. The surfaces 221, 222 are generally parallel, but the relative relationship therebetween can be varied, and the same is true of the generally rectangularly shaped condensation collection channels or chambers 223.

The entire central main tray body 211 is formed by conventional extrusion molding from the same materials as that earlier described relative to the main tray body 11 of FIGS. 1 through 3.

Means generally designated by the reference numeral 225 in the form of tray end caps or tray end walls are provided at each end of the tray 210 for closing the normally open ends thereof, though only a single tray end wall or cap 225 is illustrated. A description of the tray end cap 225 is unnecessary except to note that they are identical in construction to the tray end caps 25 and 26 of FIGS. 1 and 2.

When the coil C''' is operating in the air conditioning mode, relatively cold refrigerant (Freon) flows through the tubes (not shown but corresponding to the tube T of the coil C of FIG. 1) and in turn cools the bottom wall 212 through conduction because the bottom of the coil C''' rests directly upon the inner surface 221 of the bottom wall 212 (See FIG. 13 and 14). Warmer ambient air surrounds the condensation tray 210 including ambient air within the condensation channels/chambers 223 which is formed into condensation droplets eventually collecting within the channels 22 in sufficient amounts to form condensation which then flows outwardly of the channels 223 into the troughs (not shown) of the end caps 225 corresponding to the troughs 35 of the end caps 25, 26 for subsequent discharge to a convenient drain. It should be particularly noted that all condensation which forms upon the coil C''' is confined within the tray portion 217, and this condensation cannot flow into the tray portion 216 because of the central or longitudinal wall 215. Thus, any condensation which may be formed upon the surface 221 of the tray portion 212, as opposed to being formed within the condensation collection channels 223 therebeneath, will not flow into the tray portion 216 but will exit the tray portion 217 at the axially opposite ends thereof into the end caps 225 for subsequent discharge. Thus, no condensation can enter the outlet 187 of the fan housing 185 and adversely effect the impeller/fan thereof, the associated motor, its wiring, etc. Clearly, the tray 210 is so constructed and arranged that the fan housing 185 can direct air through the outlet 187 which in turn is fitted in an associated rectangular opening 190 (FIG. 15) of the bottom wall 212. The wall 215 prevents condensation formed from the coil C''' in the tray portion 217 from flowing into the outlet 187 or between the outlet 187 and the opening 190 to adversely effect components beneath the tray 210, such as, for example, the fan motor itself, the fan motor brackets, the fasteners for the fan motor brackets, etc. In this fashion, the fan housing 185, its motor, etc. can be supported from the tray 210, yet not be adversely effected by condensation forming upon the coils C'''.

Reference is now made to FIG. 16 of the drawings which illustrates another novel condensation pan/tray or convector pan/tray of the present invention similar to the tray 210 of FIGS. 13 through 15 which has been identically numbered, though primed, to designate like elements. Thus the tray 210' includes a central main tray body 211' defined by a bottom wall 212', opposite generally parallel side walls 213', 214, and a central or medial wall 215' therebetween. Between an inner surface 221' and an outer surface 222', there are, however, two superposed sets of generally parallel condensation channels or chambers, namely, 223' and 223''. The chambers 223' are essentially set-off between an inner generally horizontal wall portion 251, as viewed in FIG. 16, a spaced generally horizontal medial or central horizontal wall portion 252, and a plurality of ribs 224' therebetween. The lower condensation collection channels or chambers 223' are defined between the horizontal central or medial wall 252 and a lowermost or outer wall portion 253 which is parallel to the wall portion 252 and is spaced therefrom by lower bridging walls or ribs 224''. In this fashion, the chambers 223' and 223'' are arranged in superposed generally parallel relationship, as is clearly evident from FIG. 16. Maximum condensation will occur in the chambers 223 associated with the tray portion 217' because of the greatest differential temperature between the temperature of the coil C''' and the temperature of the tray 210'. If there is a considerable temperature differential between the temperature of the coil C''' and that of the tray 210' and ambient, condensation may also form and collect in the lower condensation collection chambers or channels 223''. In this fashion there are sufficient condensation collection channels or chambers 223' and 223'' to assure that all condensation which can be formed will be formed and will also be appropriately discharged through an associated end cap or wall corresponding to the end cap or wall 225 of FIG. 13.

Although a preferred embodiment of the invention has been specifically illustrated and described herein, it is to be under-stood that minor variations may be made in the apparatus without departing from the spirit and scope of the invention, as defined the appended claims.

I claim:

1. A tray for preventing the formation of condensation on at least one exterior surface thereof comprising a tray body including a bottom wall, said bottom wall including inner, medial and outer wall portions, and means for forming a condensation collection chamber between said inner and medial wall portions and said medial and outer wall portions within which condensation will form and collect due to a temperature differential between the condensation collection chambers and the exterior of said bottom wall.

2. The tray as defined in claim 1 wherein said bottom wall is of an extrusion molded construction.

3. The tray as defined in claim 1 wherein said bottom wall is of a polymeric/copolymeric extruded construction.

4. The tray as defined in claim 1 wherein said tray body includes at least one wall cooperative with said bottom wall for closing an end of said tray body.

5. The tray as defined in claim 1 wherein said tray body includes opposite end walls cooperative with said bottom wall for closing opposite ends of said tray body.

6. The tray as defined in claim 1 wherein said tray body includes at least one wall cooperative with said bottom wall for closing an end of said tray body, and said at least one wall is of an injection molded construction.

7. The tray as defined in claim 1 wherein said tray body includes opposite end walls cooperative with said bottom wall for closing opposite ends of said tray body, and said opposite end walls are each of an injection molded construction.

8. The tray as defined in claim 1 wherein said tray body includes at least one wall cooperative with said bottom wall for closing an end of said tray body, said at least one wall is of an injection molded construction, and ultrasonic bonding means for bonding said at least one wall to said bottom wall.

9. The tray as defined in claim 1 wherein said tray body includes at least one wall cooperative with said bottom wall for closing an end of said tray body, said at least one wall is of an injection molded construction, and adhesive bonding means for bonding said at least one wall to said bottom wall.

10. The tray as defined in claim 1 wherein said tray body includes opposite end walls cooperative with said bottom wall for closing opposite ends of said tray body, said opposite end walls are each of an injection molded construction, and ultrasonic bonding means for bonding at least one of said opposite end walls to said bottom wall.

11. The tray as defined in claim 1 wherein said tray body includes opposite end walls cooperative with said bottom wall for closing opposite ends of said tray body, said opposite end walls are each of an injection molded construction, and adhesive bonding means for bonding at least one of said opposite end walls to said bottom wall.

12. The tray as defined in claim including means for discharging condensation from said condensation collection chamber.

13. The tray as defined in claim 1 including at least one end cap cooperative with said bottom wall for closing an end of said tray body.

14. The tray as defined in claim 1 including at least one end cap cooperative with said bottom wall for closing an end of said tray body, and said condensation collection chambers open into said at least one end cap whereby condensation from said condensation collection chamber will flow into said at least one end cap.

15. The tray as defined in claim 1 including at least one end cap cooperative with said bottom wall for closing an end of said tray body, said condensation collection chambers open into said at least one end cap whereby condensation from said condensation collection chamber will flow into said at least one end cap, and means for discharging condensation from said condensation collection chamber.

16. The tray as defined in claim 15 wherein said bottom wall is of an extrusion molded construction.

17. The tray as defined in claim 15 wherein said bottom wall is of a polymeric/copolymeric extruded construction.

18. The tray as defined in claim 15 wherein said at least one end cap is of an injection molded construction.

19. The tray as defined in claim 1 wherein said condensation collection chambers are substantially in parallel relationship to each other.

20. A tray for preventing the formation of condensation on at least one exterior surface thereof comprising a tray body including bottom wall, said bottom wall having an interior surface and an exterior surface, means for forming at least one condensation collection chamber between said interior and exterior surfaces within which condensation will form and collect due to a temperature differential between the at least one condensation collection chamber and the exterior of said bottom wall, said tray body further including a pair of side walls disposed at opposite sides of said bottom wall, and means for defining an opening through said bottom wall and between said side walls which is adapted to receive a fan housing outlet therein.

21. The tray as defined in claim 20 including a central wall between said side walls, and said fan housing outlet opening being located between said central wall and one of said pair of side walls.

22. The tray as defined in claim 20 wherein said bottom wall includes inner, medial and outer wall portions, and said at least one and another condensation collection chamber are disposed respectively between said inner and medial wall portions and said medial and outer wall portions.

23. The tray as defined in claim 20 wherein said condensation collection chambers are substantially in parallel relationship to each other.

24. The tray as defined in claim 20 wherein said tray body includes opposite end walls cooperative with said bottom wall for closing opposite ends of said tray body, and said opposite end walls are each of an injection molded construction.

25. The tray as defined in claim 21 wherein said tray body includes opposite end walls cooperative with said bottom wall for closing opposite ends of said tray body, and said opposite end walls are each of an injection molded construction.

26. The tray as defined in claim 20 wherein said bottom wall includes inner, medial and outer wall portions, and said at least one and another condensation collection chamber are disposed respectively between said inner and medial wall portions and said medial and outer wall portions.

27. The tray as defined in claim 22 wherein said tray body includes opposite end walls cooperative with said bottom wall for closing opposite ends of said tray body, and said opposite end walls are each of an injection molded construction.

28. The tray as defined in claim 22 including at least one end cap cooperative with said bottom wall for closing an end of said tray body, and said condensation collection chambers open into said at least one end cap whereby condensation from said condensation collection chamber will flow into said at least one end cap.

29. The tray as defined in claim 22 including at least one end cap cooperative with said bottom wall for closing an end of said tray body, said condensation collection chambers open into said at least one end cap whereby condensation from said condensation collection chamber will flow into said at least one end cap, and means for discharging condensation from said condensation collection chamber.

* * * * *